United States Patent [19]

Skeen

[11] 4,131,061

[45] Dec. 26, 1978

[54] SYSTEM AND APPARATUS FOR MILLING CORN STARCH AND LIKE RAW MATERIALS

[75] Inventor: Lawrence Skeen, Springfield, Ohio

[73] Assignee: The Bauer Bros. Co., Springfield, Ohio

[21] Appl. No.: 691,240

[22] Filed: Jun. 1, 1976

[51] Int. Cl.[2] ..... B02B 1/06

[52] U.S. Cl. ..... 99/521; 99/538; 99/621; 241/261

[58] Field of Search ..... 99/514, 519–521, 99/523, 628, 538, 621, 622, 571; 241/261.2, 261.3, 296, 298, 251, 261

[56] References Cited

U.S. PATENT DOCUMENTS

| | | | |
|---|---|---|---|
| 36,350 | 9/1862 | Hendricks | 99/521 |
| 1,489,786 | 4/1924 | Povey | 241/251 |
| 1,970,330 | 8/1934 | Mason | 241/251 |
| 3,568,940 | 3/1971 | Merges | 241/261 |
| 3,806,050 | 4/1974 | Cumpston | 241/261 |

FOREIGN PATENT DOCUMENTS

| | | | |
|---|---|---|---|
| 371 of | 1870 | United Kingdom | 99/622 |

*Primary Examiner*—Harvey C. Hornsby
*Assistant Examiner*—Arthur O. Henderson
*Attorney, Agent, or Firm*—Jerome P. Bloom

[57] ABSTRACT

A disc refiner wherein the operating faces of its discs are arranged to have interdigited teeth disposed in radially spaced rows and to further have dams interposed between selected successively adjacent of said rows. The dams are characterized by being parallel to said rows and substantially coextensive therewith. Each dam is accordingly substantially continuous and each serves in the operation of the discs to block substantially all material moving across the face of the disc of which it forms a part and causes it to be deflected outwardly and to impact on the operating face of the opposing disc. The arrangement is such to insure that as the material the constituents of which are to be separated moves across the respective operating faces of opposed refiner discs it will be repeatedly thrown from one disc operating face to the other and in the process have imposed thereon a forceful separation of constituent parts.

13 Claims, 5 Drawing Figures

FIG-3
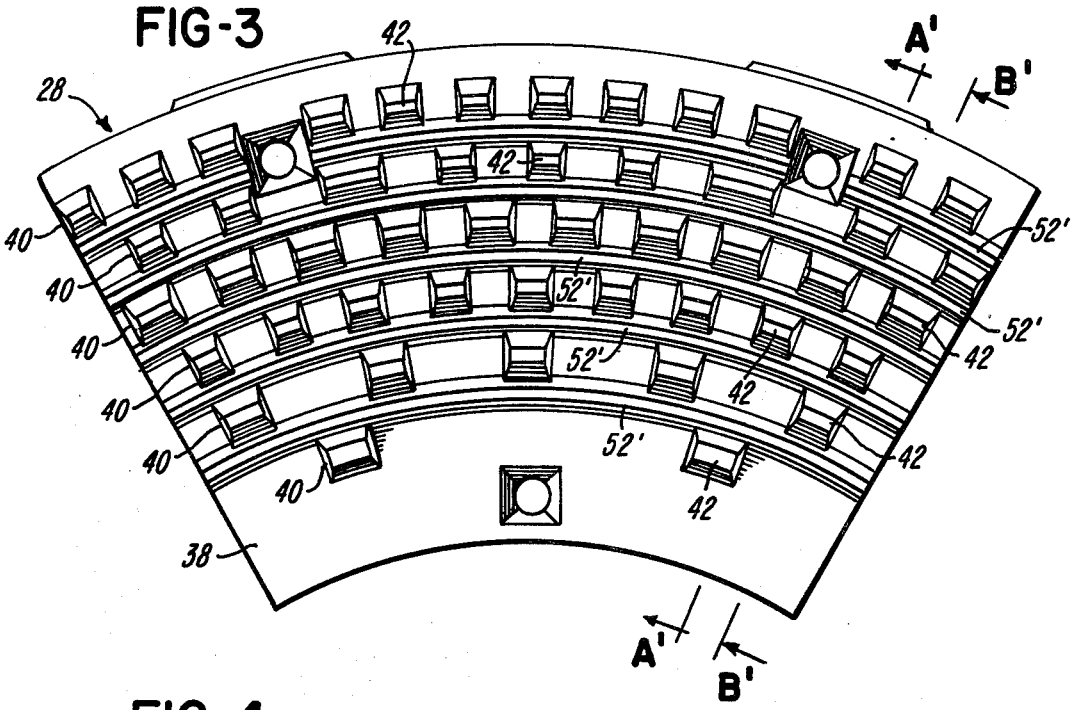
FIG-4
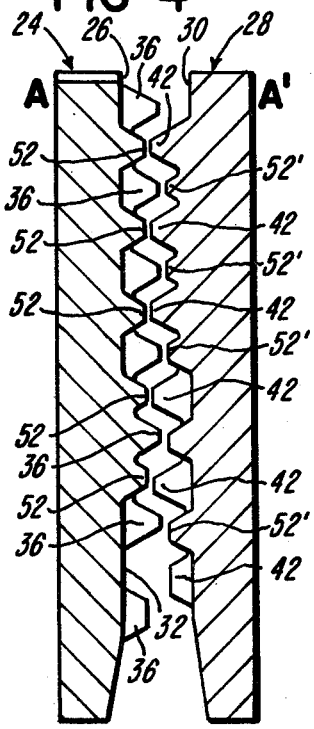
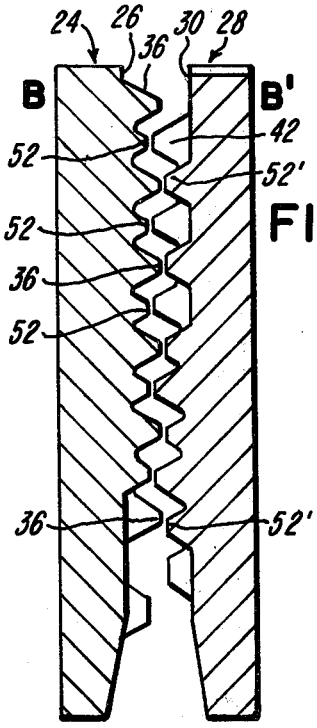
FIG-5

SYSTEM AND APPARATUS FOR MILLING CORN STARCH AND LIKE RAW MATERIALS

BACKGROUND OF THE INVENTION

This invention relates to improvements in disc mills or refiners and, more particularly, to the refiner plates which determine their useful function. It will be described, by way of illustration, and not by way of limitation, with reference to certain preferred embodiments which have, in test, proven to have special advantage and to lend a significant advance in the art of milling corn starch.

In milling corn starch the corn kernels from which the starch is extracted are passed through several separating stages, first to remove the germ and then the starch. The removal of the starch is particularly difficult since it adheres very tightly to the fibrous structure of the corn hull which forms its natural casing. Disc refiners are presently applied to this task. While it appears to be the best apparatus available for this purpose, experience indicates that such apparatus has had a limited ability to break an appreciable amount of starch loose from the hulls of corn kernels during a single pass of the de-germed kernels between its refiner plates. Contributing to the difficulties of overcoming this problem is the fact that if the refiner plates are set too closely together when applied to the separation of the corn starch, the teeth of the plates will cut and grind the fibrous corn hull. The result of this is to create fiber particles which in the process of extraction of the starch will clog the starch recovery system. This necessitates costly maintenance procedures, and shut down of the recovery operation while such procedures must be carried out. On the other hand, it has been found that due to the required spacing of the refiner plates to avoid this problem often times corn kernels will move from the inner to the outer radial limits of the plates between which they must pass through paths which circumvent the interdigited refiner teeth. Such problems as this contribute to the limited percentage of starch extraction that has been experienced in the use of a disc refiner as heretofore constructed and comprised.

SUMMARY OF THE INVENTION

The present invention provides a significantly improved disc refiner, as related to its ability to more effectively separate constituents of materials on which it acts, with minimal damage to its fiber content, if any. It has particular benefits in corn starch milling in that it has the capability of insuring the extraction of a much greater amount of starch from de-germed corn kernels in a single pass. By the same token, as should become obvious, the very features of the present invention which make it desirable in application to a separation of starch from corn hulls makes it obviously and advantageously desirable for application to the separation of pre-treated fiber bundles which have been extracted from wood chips, into their constituent fiber parts, with minimal damage to the individual fiber content.

The invention is achieved by the creation of an improved refiner plate. The operating surface of such plate will conventionally have a plurality of tooth-like projections. In the embodiment illustrated a portion of these projections is arranged in radially spaced lines or rows, in each of which lines or rows the projections are disposed in a spaced side by side relation. According to the invention, a further tooth-like projection which is laterally extended and relatively unbroken is employed to form a dam positioned in connection with and projected from the base of the operating surface intermediate selected successively adjacent of such rows. The dam, in each case, functions to block the direct movement of material over the base of said operating surface in by-passing relation to the tooth-like projections which define said rows. A plurality of these dams are employed. As will be described, they function to insure not only that the material moving across the operating surface will be subjected to an effective separating action but that no such material will bypass a separating action. In preferred embodiment the dams have a depth of projection less than that of the tooth-like projections in the rows between which they position.

The invention thus provides a disc refiner embodying discs, one of which is rotatable relative the other, each of which discs has means defining an operating face from the base of which project a plurality of teeth arranged in radially spaced rows. In each of such rows the teeth are relatively short in lateral extent and in side by side spaced relation. In the positioning of the discs for their operation, their operating faces are positioned in opposed spaced relation so as to provide that the teeth of said rows are interdigited. Per the invention the disc operating faces embody dams positioned intermediate selected successively adjacent of said rows of spaced teeth and the dams are so provided as to be relatively unbroken and substantially coextensive in length with the rows between which they position. As one of the discs is moved relative the other in a disc refining procedure, the dams embodied in and projected from their operating faces serve to block the material, a constituent part of which is to be separated, from moving thereby across the face of the disc of which it forms a part and to cause the material to be deflected outwardly and to impact on the operating face of the opposite disc. The arrangement is such that as material is directed between the operating faces of the discs and moves between the limits thereof it will be repeatedly thrown from one operating face to the other and in the process have imposed thereon a forceful separation of constituent parts.

It is a primary object of the invention to provide improvements in disc refiners enabling them to be more satisfactorily used for separating constituent parts of materials to be refined.

Another object of the invention is to provide an improved refiner plate which may be utilized to more completely separate constituents of material by deflection and impact procedures without material damage to its constituent parts.

A further object of the invention is to provide new and improved refiner plates embodying radially spaced rows of teeth, in each of which rows the teeth are disposed in side by side spaced relation, characterized in that dams are provided between selected successively adjacent, radially spaced, rows of said teeth, which dams are substantially unbroken as they extend substantially continuously to have the effective length thereof substantially equal to that of the rows between which they position.

An additional object of the invention is to provide a disc refiner and refiner plates possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of the embodiment is illustrated, FIG. 1 is a cross sectional view of a double revolving disc refiner which is diagrammatically illustrated except in reference to the details of its refiner plates which embody improvements of the present invention;

FIG. 3 is a plan view similar to that of FIG. 2 showing the refiner plates of the disc unit on the right;

FIG. 4 is a cross sectional view of the opposed refiner plates of FIG. 1, taken on lines A—A and A'—A' of FIGS. 2 and 3; and FIG. 5 is a cross sectional view of the opposed refiner plates taken on lines B—B and B'—B' of FIGS. 2 and 3.

Like parts are indicated by similar characters of reference throughout the several views.

Figure 1:
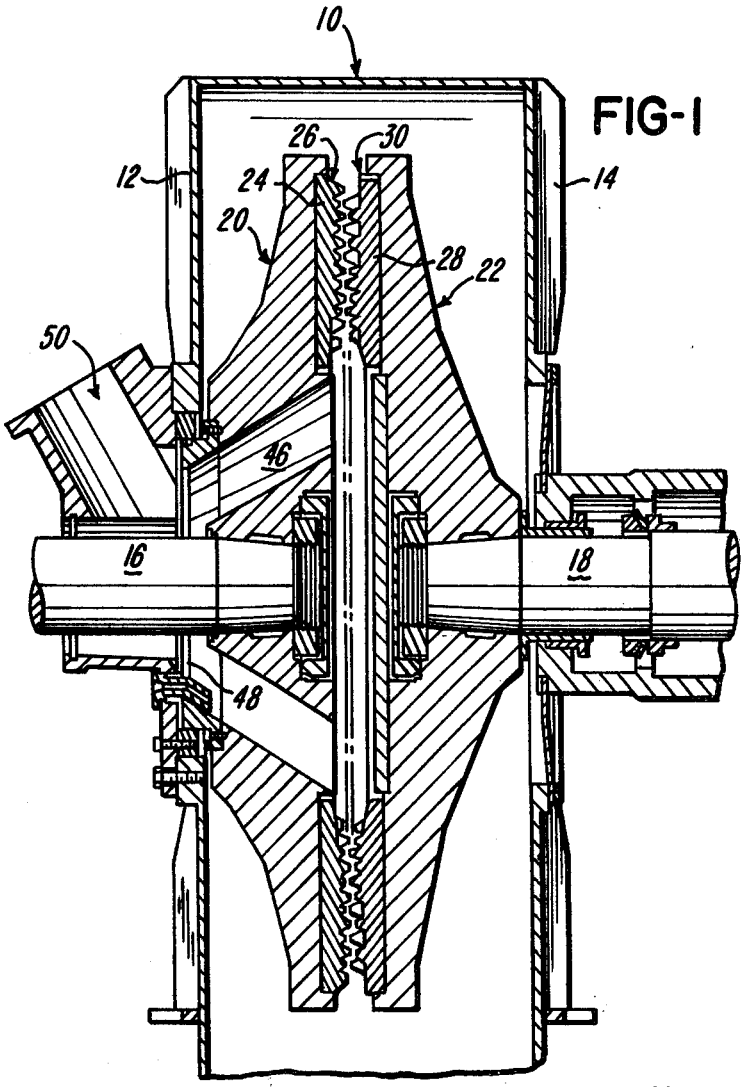

FIG. 1 of the drawings illustrates only generally and diagrammatically a refiner case 10 through opposite wall surfaces 12 and 14 of which project, respectively, a drive shaft 16 and a drive shaft 18. Fixed on the end of the drive shaft 16 interiorly of the case 10 is a disc 20. Similarly fixed on the end of the shaft 18 interiorly of the case 10 is a disc 22. The discs 20 and 22 are positioned in opposed relation and the disc 20 mounts, on its face adjacent the disc 22, a series of refiner plates 24 forming on the outermost face thereof an annular operating surface 26. The disc 22 similarly mounts a series of refiner plates 28 defining its annular operating surface 30. As the drive shafts are positioned, the operating surfaces 26 and 30 dispose in a directly opposite facing relation.

Figure 2:
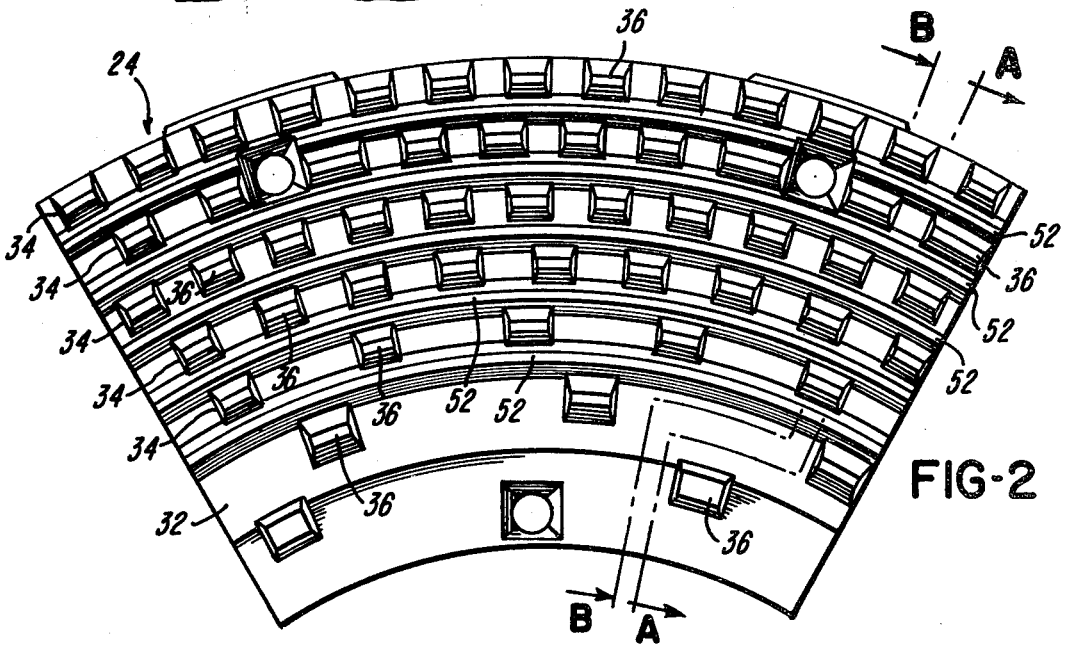
FIG. 2 is a plan view of a refiner plate per the present invention, a plurality of which define the refining surface of the disc unit shown on the left in FIG. 1.

Projecting from the base 32 of the operating surface 26, and formed integral therewith, are a plurality of teeth 36 arranged in a plurality of arcuately formed, radially spaced, lines or rows 34 the arc of each of which has as its center a point on the central axis of the disc 20. As may be seen in FIG. 2, the teeth 36 have a short lateral extent, are trapezoidally shaped, and arranged in side by side spaced relation in each row.

Projecting from the base 38 of operating surface 30 of disc 22, and formed integral therewith, are a plurality of teeth 42 similar to the teeth 36 which are similarly arranged in a plurality of arcuately formed lines or rows 40.

Each refiner plate has a configuration providing it with inner and outer edges which are respectively arcuate, each of which edges is formed on a different radius. The lines defined by the lateral edges of the plates join the radially aligned extremities of its inner and outer arcuate edges and, thereby, are radially oriented and outwardly divergent by reason of the fact that the outer arcuate edge is longer than the inner. Each plate has a mounting bolt hole in a portion relatively adjacent its inner edge and centered in reference thereto. Each plate also includes coupling portions (not shown) at the rear to enable further anchoring thereof, in a conventional manner, to the disc 20. In the example shown, six of the plates 24 will be applied to the outer face of the disc 20 to form thereon an annular operating surface, while six of the plates 28 likewise provide the operating surface of the disc 22. It is to be understood that the number of plates to form said operating surface need not be so limited. Any number of plates such as 28 may be employed provided that in total they may be applied to form an annular operating surface.

Noting FIG. 1, the disc 20 comprises an infeed disc which includes a series of infeed passages 46 arranged in a circularly spaced relation immediately about its central hub portion which mounts to the shaft 16. The inlet ends of the passages 46 open adjacent the inlet opening 48 provided in the wall 12 and the passages 46 are arranged to diverge as they are directed interiorly of the case 10 to open from the outermost face of the disc 20 immediately adjacent the inner peripheral arcuate edge portions of the refiner plates 24 which form a circle peripheral thereto.

The inlet opening 48 is extended by an upwardly and outwardly inclined feed spout 50 which is of conventional construction designed to direct material the constituent parts of which are to be separated to and through the inlet 48 and the passages 46 provided in the infeed disc 20. As generally indicated in FIG. 1, the drive shafts 16 and 18 are provided with bearings in the wall structure of the case 10 and the feed spout 50 through which they extend and in which they may rotate. It will of course be obvious that the drive shafts 16 and 18 will extend to and connect with conventional drive motors for their respective individual rotation, which in the double revolving disc refiner of the type illustrated will drive the discs in respectively opposite directions. The details of this structure, which may be conventionally contrived by those versed in the art, are not further described or illustrated since per se they form no part of the present invention. For an example of such details, reference is made to U.S. Pat. No. 3,207,450.

Projected from the base 32 of the operating surface 26 of each refiner plate 24 is a series of radially spaced tooth-like projections 52. Each projection 52 is located between a successively adjacent pair of rows 34 of teeth 36, the adjacent inwardly convergent sides of the teeth of which overlap and blend into the respective radially innermost and radially outermost inwardly divergent sides of the intermediately located projection 52, above the base 32. On its outermost, projected end, each projection 52 has a flat which lies substantially parallel to the base 32 and inwardly of the level of the plane defined by the projected extremities of the teeth 36 which is also substantially parallel to the base 32. Thus, the depth of the projection 52 is in each case less than that of the teeth 36. Moreover, each projection 52 is distinguished in that it has, in a longitudinal sense, an arcuate configuration and in that it is continuous and relatively unbroken as it extends from one lateral radially oriented edge to the other of the plate 24 of which it forms a part. As illustrated, the arc of each projection 52 is formed about a uniform radius the center of which lies in the central axis of the disc 20 and the shaft 16 to which it mounts. As may be seen in FIG. 2, in the left hand plates 24 there are seven rows or lines of teeth 36 which are radially spaced and a single projection 52 is positioned between each of the second and third rows; the third and fourth rows; the fourth and fifth rows; the fifth and sixth rows; and the sixth and seventh rows of the teeth 36.

The operating face of each plate 28 is provided with a series of radially spaced tooth-like projections identical in configuration and arrangement with the projections 52 but in this case identified by the numeral 52'. Similarly, each projection 52' is located between a successively adjacent pair of rows 40 of teeth 42, the adjacent inwardly convergent sides of which overlap and blend into the respective radially innermost and radially outermost inwardly divergent sides of the intermediately positioned projection 52', above the base 38. The depth of the projections 52' is less than that of the teeth 42 and their lateral extent is such that each projection 52' is continuous and relatively unbroken in its arc-like configuration as it extends from one lateral edge to the other of the plate 28 of which it forms a part.

The plates 28 are distinguished in that they have only six rows 40 of the teeth 42 and only five radially spaced tooth-like projections 52', the latter being respectively positioned between successively adjacent of the rows 40, in alternating relation thereto, within the second and the sixth rows of the teeth 42, the latter of which rows is radially outermost.

Thus, each of the discs 20 and 22 on the face thereof opposite the other disc has an annular operating surface provided by a series of six refiner plates in connection therewith. As the proposed sets of plates 24 and 28 are arranged, as seen in FIGS. 4 and 5, the respective rows of teeth 36 and teeth 42 thereof are offset, in a radial sense, and interdigited. Moreover, the tooth-like projections from the base of the operating surface of each of the refiner discs form ring-like concentric dams the function and obvious effect of which is to prevent a bypassing flow of the material upon which the disc refiner is to operate from the radially innermost to the radially outermost edge thereof by way of passages defined by the spaces between the teeth 36 in the one case and the teeth 42 in the other case. In this composite the tooth-like projections 52 and 52' are not only radially spaced and interposed in blocking relation between rows of laterally spaced teeth on the plates of which they form a part but they present radially offset obstructions with respect to the flow path of material to be moved from the inner to the outer limits of the annular refining surfaces.

As will be obvious, from FIG. 1, as material the constituents of which are to be separated is directed to the refiner, it will enter the refiner by way of the feed spout 50 to pass through the passages 46 of the infeed disc 20 and to the space between the discs 20 and 22 at their centers, from which space the inner peripheral edges of the opposed refiner plates define a radially outwardly directed convergent throat leading to and between the operating surfaces provided by the refiner plates on the discs.

Where the disc refiner is to be applied to the milling of corn starch, normally in a third stage following a de-germing process, the kernels of corn, comprised of a fibrous casing to the inner surface of which is firmly adhered a substance which is primarily starch, will be entrained in a slurry form as they are delivered for a separating procedure to the interior space between the disc units of the refiner by way of the feed spout 50 and flow passages 46. In accordance with the practice of the invention, as the kernels move radially outward between the operating surfaces of the refiner disc units, there will be a starch release effected by reason of impact and turbulence in the flow. In the preferred utilization of the invention apparatus the spacing of the projected teeth 36 and 42 in the various rows from the base of the operating surface of the opposed disc will be in the neighborhood of ⅜ inch. In the course of moving radially outward over and between the projected teeth of the rows on each of the sets of plates 24 and 28 the kernels which move adjacent the base portions of the operating surfaces of the plates will first contact the innermost ring-like dams provided by the tooth-like projections 52 and 52'. This prevents a direct passage adjacent the base of the respective operating surfaces, as would be possible utilizing normal or conventional refiner plates. In the case of the invention the dam elements which are essentially continuous in nature serve to not only provide an impact surface for the corn kernels but to fling the impacted corn kernels outwardly from the plate of which it forms a part to impact on the operating surface of the opposite disc unit. As will be readily seen, on each impact further amounts of starch will be loosened from the corn hulls. With the repeated and successive impact provided by the radially spaced tooth-like projections 52 and 52' there is achieved a multiple de-starching effect which has proven in test to reduce bound starch normally lost due to adhesion to the fiber of the corn hulls from approximately 21% to an average of 13%. The significance of this is believed obvious. Of course, inherent in the construction provided for the refiner plates and the operating surfaces of the discs of the refiner is a greater turbulence induced in the flow from the inner to the outer surfaces of the refiner plates. Thus, the rebounding effect as provided by the dams not only insures the rebound action but in the process a degree of impacting as between the corn kernels, all lending an impact effect to free the starch from the corn hulls.

In the process of utilizing the plates of the invention and the improved disc refiner which they provide, the incidence of direct and free flow of corn kernels through devious paths to escape from between the refiner plates without any essential removal of starch has been substantially eliminated.

The net result is that a maximum of starch is removed from the corn hulls or casings of the kernels, minimizing the need for repeated starch extracting passes such as has been previously required to obtain a reasonable amount of extraction of what the trade has called "bound" starch.

It should be obvious that by maximalizing the removal of starch, and particularly in a single pass, there is a substantial increase in the value of the end product. The starch, of course, can be used as starch or converted to sugar. The fibrous hulls are normally converted to animal feed and if the starch is lost in the fibrous hull and cannot economically be removed, it not only represents a loss of return but it can cause a raising of the fat level in the hulls which are to be used as a high protein feed. This means that the quality of the feed is substantially reduced and correspondingly the value of this constituent of the corn kernels is minimized.

Incident to the function of the refiner plates of the invention is the fact that they can be used with a wide spacing and with a maximum recovery of starch and at the same time the fibrous hull is not cut and fragmented to deposit in the starch and form a clogging influence on the starch recovery system.

The foregoing is the description of a preferred embodiment and application of the invention. However, as noted previously, the application of the invention need not be so limited. Inherent in the utilization thereof is the feasibility of applying plates of the nature described in a disc refining directed to the separation of fiber bundles derived from pre-treated wood chips into their component fiber parts. That this can be done by impact utilizing the principle of the invention should be readily obvious. All one needs do is to modify the controls, the size and positioning of the teeth and the dams on the operating surfaces of the refiner plates, and/or the relative speed of their rotation. It should be self-evident that where substance bonding the fibers of the fiber bundles are first chemically weakened, an impacting operation by means such as described may achieve a ready separation of individual fibers which preserves them in a relatively unscarred condition and in an individual form which maximalizes the quality of the resultant product in which they are employed.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A refiner plate having an operating face comprising a base surface from which projects a plurality of teeth, a portion of said teeth being arranged in a spaced side by side relation to form rows thereof, each of which rows have a generally arcuate configuration, said rows being arranged in a spaced relation between an inner and an outermost edge of said base surface, another portion of said teeth comprising projections which lie between adjacent of said rows and extend substantially coextensive therewith as a single relatively unbroken projection from said base surface, each of said relatively unbroken projections including surface portions facing the inner edge of said base surface to cause material moving over and adjacent said base surface which impact thereon to deflect outwardly from said surface and at angles providing that they tend to approach the outermost edge of said base surface, said rows of teeth being arranged to dispose in a radially spaced relation and said projections which lie between adjacent of said rows and extend substantially coextensive therewith being arranged in radially spaced relation and interspersed among said rows of teeth to prohibit movement of materials the constituents of which are to be separated directly across said base surface in paths defined by the spaces between said first mentioned portion of said teeth in said rows, the level of projection of said first mentioned portion of said teeth comprising said rows being greater than that of said another portion of said teeth.

2. A refiner plate having an operating face comprising a base surface from which projects a plurality of teeth, a portion of said teeth being arranged in a spaced side by side relation to form rows thereof, each of which rows has a generally arcuate configuration, said rows being arranged in a spaced relation between an inner and an outermost edge of said base surface, another portion of said teeth comprising projections which lie between adjacent of said rows and extend substantially coextensive therewith as a single relatively unbroken projection from said base surface, each of said teeth comprised in said another portion of said teeth being formed on a generally uniform arc and said teeth comprised in said another portion being disposed in alternating relation with selected rows of said teeth, within the limits of said inner and outer edges of said base surface, providing thereby for particles or fluid moving adjacent said base surface to be insured of deflection outwardly from said base surface on coming in contact with said another portion of said teeth in being moved from a location adjacent the inner to the outer edge of said base surface.

3. A refiner plate as in claim 2 wherein said another portion of said teeth are merged and overlapped adjacent their base portions by base portions of said first mentioned portion of said teeth in said rows between which they are positioned.

4. A refiner plate as in claim 3 characterized in that said first mentioned portion of said teeth arranged in said rows have a generally trapezoidal configuration.

5. A refiner plate as in claim 2 characterized in that said another portion of said teeth have a degree of projection from said base surface which is less than that of said teeth in said rows.

6. Refiner apparatus including a refiner plate comprising a base surface from which projects a plurality of teeth, a portion of said teeth being arranged in a spaced side by side relation to form rows thereof, each of which rows has a generally arcuate configuration, said rows being arranged in a spaced relation between an inner and an outermost edge of said base surface, another portion of said teeth comprising projections which lie between adjacent of said rows and extend substantially coextensive therewith as a single relatively unbroken projection from said base surface, each of said relatively unbroken projections including surface portions facing the inner edge of said base surface, a pair of discs disposed in opposing facing relation, to each of the opposed surfaces of which one or more of said plates is secured to provide that the base surfaces of said plates on the respective discs are paired in opposed spaced relation and means are connected for drive of one of said opposed discs relative the other, said another portion of said teeth comprising single relatively unbroken projections being disposed on the opposed base surfaces of said plates to successively deflect materials moving between said opposed plates to cause them to impact on the opposing plate.

7. Refiner apparatus comprising opposing discs providing opposing annular operating surfaces each comprised of plural plates, the base of each said plate being characterized by projections forming, on each of said operating surfaces, rows of circumferentially spaced apart teeth and there being provided between at least certain rows of said teeth a ring-like projection defining further tooth-like projections, corresponding rows of teeth on said opposing operating surfaces of said discs being radially offset from one another, a row of teeth of one operating surface being opposed by a ring-like projection on the opposing operating surface and said ring-like projections being relatively low in height as compared to the height of said teeth to allow corresponding tooth rows to occupy an interdigited relation while maintaining a spaced relation of said ring-like projections relative to the teeth of opposing tooth rows.

8. A disc mill including a pair of relatively rotatable discs in a face to face relation, the opposing disc faces each having an annular milling surface, means for introducing material for milling between opposing faces of said discs at a location centrally thereof to be moved by centrifugal force radially outward between the discs for peripheral discharge, said milling surfaces being in an opposed relation to one another and each including radially spaced rows of circumferentially spaced apart teeth and there being provided between at least certain tooth rows a ring-like projection defining deflecting means providing radially spaced, laterally extended, substantially ring-like impact surfaces projected from each of the opposing faces of said discs for repeatedly and successively deflecting outwardly moving material from one disc face to the other and in a sense radially outward of said discs to utilize a principle of impact in separating material into constituent parts, the milling surfaces of the respective disc faces being so constructed and so oriented that a ring-like projection of a milling surface on one disc face positions generally opposite a tooth row of a milling surface on the opposing disc face.

9. A disc mill including a pair of relatively rotatable discs in a face to face relation, means for introducing material for milling between opposing faces of said discs centrally thereof to be moved by centrifugal force radially outwardly between the discs for peripheral discharge, means on the opposing faces of said discs repeatedly deflecting outwardly moving material from one disc face to the other to utilize a principle of impact in separating material into constituent parts, said opposing disc faces each having an annular milling surface, said milling surfaces being in an opposed relation to one another and each including radially spaced rows of circumferentially spaced apart teeth and between at least certain tooth rows a ring-like projection defining said deflecting means, corresponding tooth rows of opposite milling surfaces being radially offset from one another, the tooth row of one milling surface being opposed by a ring-like projection on the other milling surface, and said ring-like projections being relatively low in height as compared to said teeth to allow corresponding tooth rows of occupy an interdigited relation while maintaining a spaced relation of said ring-like projections relative to teeth of opposing tooth rows.

10. A disc refiner including a pair of discs one of which is rotatable relative the other, said discs each having thereon means defining an annular refining surface, said discs being positioned to dispose said refining surfaces in an opposed closely spaced relation, each said refining surface including a base from which project a plurality of teeth arranged in radially spaced lines, a portion of which lines comprise teeth arranged in a spaced apart relation and the balance of which lines present individual teeth providing relatively unbroken surfaces which extend substantially coextensive with the lines in which teeth are spaced apart and so as to lie substantially entirely across the path of material which may be directed from the inner to outer peripheral limits of the refining surface of which they form a part, the said teeth on said refining surfaces being arranged so that the portion of said lines defining said balance thereof on the respective refining surfaces are successively offset from one to the other of said refining surfaces, in a radial sense, and arranged so that each of the teeth thereof presents a deflecting surface facing the inner peripheral limit of said refining surfaces including a surface portion angled to cause material moving over and adjacent the base of the said refining surface of which it forms a part which impacts thereon to deflect outwardly thereof in a direction towards the opposed refining surface and more closely approaching the outer peripheral limit of said refining surfaces.

11. A disc refiner as in claim 10 wherein the teeth in said balance of said lines have a depth of projection which is less than that of said teeth in lines thereof wherein the teeth are arranged in a spaced apart relation.

12. A disc refiner as in claim 11 wherein said lines of spaced apart teeth are comprised of teeth which have a generally trapezoidal shape and sides which are configured to be outwardly convergent from their base.

13. A disc mill including a pair of facing relatively rotatable discs the facing portions of which provide the disc operating surfaces, one of said discs having a central infeed opening for the introduction of material for milling between said disc operating surfaces centrally of said operating surfaces to be moved by centrifugal force radially outwardly between said disc operating surfaces for discharge from their periphery, ring-like projections on the opposed operating surfaces of said discs interspersed between rows of teeth projecting from said operating surfaces, the ring-like projections on the respective discs being in a radial sense in an alternating offset relation to one another and providing surfaces in the path of material moving radially outward between said discs to influence material which impacts thereon to be deflected to the opposite operating face and in a sense radially outward of said ring-like projections.

* * * * *

UNITED STATES PATENT AND TRADEMARK OFFICE

CERTIFICATE OF CORRECTION

PATENT NO. : 4,131,061

DATED : December 26, 1978

INVENTOR(S) : Lawrence Skeen

It is certified that error appears in the above-identified patent and that said Letters Patent are hereby corrected as shown below:

In the ABSTRACT, line 11, "opposing" is corrected to read -- opposite --.

Col. 5, line 35, "this" is corrected to read -- their --.

Col. 7, line 39 (Claim 1, line 5),"have" is corrected to read -- has --.

Col. 9, line 46 (Claim 9, line 21), "of" is corrected to read -- to --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*